US010914563B2

(12) United States Patent
McNelis et al.

(10) Patent No.: US 10,914,563 B2
(45) Date of Patent: Feb. 9, 2021

(54) SHAPED CHARGE METAL FOAM PACKAGE

(71) Applicant: DynaEnergetics Europe GmbH, Troisdorf (DE)

(72) Inventors: Liam McNelis, Bonn (DE); Frank Haron Preiss, Bonn (DE); Joern Olaf Loehken, Troisdorf (DE); Arash Shahinpour, Troisdorf (DE); Joerg Mueller, Bonn-Lengsdorf (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 293 days.

(21) Appl. No.: 15/781,876

(22) PCT Filed: Nov. 7, 2016

(86) PCT No.: PCT/EP2016/076877
§ 371 (c)(1),
(2) Date: Jun. 6, 2018

(87) PCT Pub. No.: WO2017/097512
PCT Pub. Date: Jun. 15, 2017

(65) Prior Publication Data

US 2018/0356195 A1 Dec. 13, 2018

Related U.S. Application Data

(60) Provisional application No. 62/276,342, filed on Jan. 8, 2016, provisional application No. 62/264,037, filed on Dec. 7, 2015.

(51) Int. Cl.
*F42B 39/24* (2006.01)
*F42B 39/14* (2006.01)

(52) U.S. Cl.
CPC ..... *F42B 39/24* (2013.01); *F42B 39/14* (2013.01)

(58) Field of Classification Search
CPC ..... F42B 39/24; F42B 39/14; F42B 39/00; F42B 39/22; F42B 39/26; F42B 39/30;
(Continued)

(56) References Cited

U.S. PATENT DOCUMENTS 2,954,140 A * 9/1960 Sutherland ..... B65D 85/68 217/53
3,181,693 A * 5/1965 Freistat ..... A45C 13/02 206/523
(Continued)

FOREIGN PATENT DOCUMENTS

CA 2606873 A1 5/2008
CN 2764605 Y 3/2006
(Continued)

OTHER PUBLICATIONS

Uniteam, Special Containers, Storage Containers for Explosives, Jun. 5, 2017, 3 pgs., https://www.uniteam.com/en/containers/special-containers/explosive-containers/.
(Continued)

*Primary Examiner* — Chun Hoi Cheung
*Assistant Examiner* — Brijesh V. Patel
(74) *Attorney, Agent, or Firm* — Moyles IP, LLC

(57) ABSTRACT

An apparatus for storing and/or shipping explosive components, such as shaped charges, is generally described. In an embodiment, the apparatus includes a shielding assembly. The shielding assembly may include a shielding panel having a body made of metal foam and an aperture formed within the body. In an embodiment, the body is sandwiched between an upper and a lower layer. The shielding panel is configured to receive a shaped charge. Thus, the apparatus is capable of at least preventing and/or limiting ballistic transfer in the event of detonation of a shaped charge.

18 Claims, 9 Drawing Sheets

(58) Field of Classification Search
CPC ..... F42B 1/032; B29C 66/727; B65D 81/022; B65D 81/07; B65D 81/051; B65D 81/113; B65D 5/509
USPC ..... 206/523, 3, 443, 433, 521, 528, 317; 220/560.01, 902; 217/53, 35, 52, 27; 89/34
See application file for complete search history.

(56) References Cited

U.S. PATENT DOCUMENTS 3,241,661 A * 3/1966 Zamzow ..... B65D 85/305 206/433
3,757,933 A * 9/1973 Banta ..... B65D 81/02 206/3
3,838,643 A 10/1974 Austin et al.
4,055,247 A * 10/1977 Benedick ..... F42B 39/14 206/3
4,106,597 A * 8/1978 Shook ..... A45C 11/20 190/110
4,248,342 A * 2/1981 King ..... F42B 39/14 109/49.5
4,286,708 A 9/1981 Porzel
4,440,296 A * 4/1984 Howe ..... F42B 39/14 206/3
4,640,418 A * 2/1987 Lowry ..... B65D 5/509 206/499
4,805,776 A * 2/1989 Namgyal ..... A45C 3/00 206/523
4,898,104 A 2/1990 Savoy et al.
4,955,480 A * 9/1990 Sexton ..... B65D 81/18 206/438
4,973,358 A * 11/1990 Jin ..... B22D 25/005 164/79
5,040,678 A * 8/1991 Lenmark, Sr. ..... B65D 81/107 206/204
5,097,945 A 3/1992 Brooks
5,151,246 A * 9/1992 Baumeister ..... B22F 3/1125 264/44
5,158,173 A 10/1992 Halsey et al.
5,160,473 A * 11/1992 Bontrager ..... B65D 81/107 206/523
5,181,549 A * 1/1993 Shapovalov ..... B22D 27/13 164/122.1
5,219,504 A * 6/1993 Insley ..... B01L 9/06 264/109
5,248,055 A 9/1993 Sanai et al.
5,356,009 A * 10/1994 Lubowitz ..... B29C 66/727 206/524
5,390,580 A * 2/1995 Gibbons, Jr. ..... F41H 5/0457 109/49.5
5,450,948 A * 9/1995 Beausoleil ..... B65D 81/264 206/204
5,654,053 A * 8/1997 Crane ..... B32B 5/18 428/36.5
5,996,777 A * 12/1999 Capers, III ..... F42B 39/30 206/3
6,196,107 B1 3/2001 Hoffman et al.
6,305,539 B1 * 10/2001 Sanders, Jr. ..... B65D 5/6664 206/320
6,347,700 B1 * 2/2002 Redfield ..... F42B 39/00 206/3
6,391,250 B1 * 5/2002 Wolfsgruber ..... B22F 3/1125 419/2
6,454,085 B1 9/2002 Barker
6,581,504 B2 6/2003 Caron
6,698,331 B1 3/2004 Yu et al.
7,152,736 B1 * 12/2006 Menichini ..... B01L 9/06 206/443
7,204,183 B2 4/2007 Cirillo
7,416,076 B2 8/2008 Barton et al.
8,079,465 B2 * 12/2011 Edwards ..... F42B 39/26 206/3
8,505,723 B2 * 8/2013 Clark ..... B65D 5/503 206/443
9,072,653 B2 * 7/2015 Nemard ..... A61J 1/03
2002/0092793 A1 7/2002 Barker
2005/0150781 A1 7/2005 Barton et al.
2005/0247450 A1 11/2005 Ratanasirigulchai et al.
2007/0131684 A1 6/2007 Cirillo et al.
2007/0248807 A1 * 10/2007 Kaschak ..... F42B 1/032 102/306
2008/0282924 A1 * 11/2008 Saenger ..... F42B 1/032 102/306
2014/0008247 A1 * 1/2014 McNelis ..... F42B 39/24 206/3
2016/0211038 A1 * 7/2016 Houillon ..... B65D 81/022

FOREIGN PATENT DOCUMENTS

EP 02992531 A1 1/1989
GB 2514798 A * 12/2014 ..... F42B 39/14
WO WO-2010003858 A1 1/2010

OTHER PUBLICATIONS

Havel Metal Foam, Innovative Solutions for lightweight Construction, Dec. 4, 2015, 4 pgs., http://en.havel-mf.com/home.
Havel Metal Foam, Metal foam sandwiches for civil protection and mobile infrastructure, May 12, 2015, 2 pgs., http://en.havel-mf.com/home.
Kerry J. Libbert, Performance Oriented Packaging Testing of PPP-B-601 Wood Box, Presented to Naval Surface Warfare Center, Crane, Indiana, Nov. 1993, 10 pgs.
International Search Report and Written Opinion of International App. No. PCT/EP2016/1076877, dated Jan. 20, 2017, 12 pgs.
Canadian Intellectual Property Office, Office Action of International App. No. EP2016076877, which is in the same family as U.S. Appl. No. 15/781,876, dated Jun. 17, 2019, 3 pgs.

* cited by examiner

SHAPED CHARGE METAL FOAM PACKAGE

CROSS-REFERENCE TO RELATED APPLICATIONS

This application claims priority to PCT Application No. PCT/EP2016/076877 filed Nov. 7, 2016, which claims priority to U.S. Provisional Application No. 62/264,037 filed Dec. 7, 2015, which is incorporated herein by reference in its entirety.

FIELD

A device and a method for providing a packaging assembly for storing and shipping shaped charges including a shielding assembly having shielding panels that prevent/limit ballistic transfer from one explosive component to another explosive is generally described.

BACKGROUND

Shaped charges are typically used to make perforations within a wellbore. In order to make these perforations, shaped charges typically include an explosive material positioned in a cavity of a housing, with or without a liner positioned therein. Often, the explosive materials are selected so that they have a high detonation velocity and pressure. When shaped charges are initiated, the explosive material is detonated which may cause the liner to produce a forward-moving high velocity perforating jet that is ejected from the housing at a high velocity. These shaped charges serve to focus the ballistic energy on a target, thereby producing a round perforation hole in, for example, a steel casing pipe or tubing and/or a formation. The ballistic energy may create a detonation wave that collapses the liner, thereby forming the perforating jet that travels through an open end of the casing housing the explosive charge. The jet pierces the perforating gun casing and forms a cylindrical tunnel into the surrounding target formation.

Because well perforations are performed on a world-wide basis, shaped charges are often shipped using commercial and private carriers. As such, shipping of shaped charges is highly regulated by various government agencies, primarily for safety purposes since they contain explosive materials. In order to ship explosives or components containing explosives, commercial and private carriers typically require a United Nations (UN) 1.4S shipping classification that demonstrates that the packaging method for the explosives has been established as safe for highway and private or commercial aircraft conveyance, particularly passenger-carrying aircraft. Typically, tests are conducted to determine the shipping classification of an explosive article and, particularly, the ability of the article and its packaging to prevent or contain multiple or mass detonation of the explosive.

One of the most common series of tests performed is described in the United Nations Recommendations on the Transport of Dangerous Goods as Test Series 6, which includes a series of tests performed on packages of explosive articles. These tests include, for example: (1) a single package test to determine if there is potential for mass explosion of the contents; (2) a stacked packages test to determine whether an explosion is propagated from one package to another or from a non-packaged article to another; and, (3) an external fire test to determine whether there is a mass explosion or a hazard from dangerous projections, radiant heat and/or violent burning or any other dangerous effect when the package is involved in a fire.

Known methods for shipping and/or storing shaped charges include placing shaped charges in a protective packaging, such as a transportation holder having walls. The transportation holders are typically arranged in an inner cardboard packaging, which is in turn arranged in a vacuum-sealed foil bag. The foil bag may house one or more inner cardboard packages and is thereafter placed in a standard shipping container, often made of one or more layers of wood or corrugated cardboard. A disadvantage of this packaging is that it may fail to contain significant metal shrapnel, which can result from inadvertent detonation of a shaped charge within the shipping container, particularly large shaped charges and shaped charges of a non-circular design, which generate significant shrapnel upon detonation. Thus, such package designs may not sufficiently prevent mass detonation of shaped charges in a manner that ensures safe conveyance of large shaped charges and non-circular shaped charges, using private or commercial transportation means by road, rail, air or sea.

FIG. 1 depicts a prior art packaging assembly 1 for packaging explosive products, such as shaped charges 2, for storage and/or transportation, which may fail to contain shrapnel pieces in the event of detonation. The shaped charges 2 are positioned in first and second layers 3A, 3B, with their respective liners 22 (shown in FIG. 9 and described in further detail hereinbelow) facing each other. Jet spoilers (not shown) are positioned adjacent to each liner 22, such that the jet spoilers oppose each other. The assembly includes shielding panels 4 positioned between and around each shaped charge 2, such that each shaped charge 2 includes a minimum of six shielding panels 4 positioned around it. The shielding panels 4 are made of materials that include wood, aluminum, corrugated cardboard or woven ballistic cloth. One shaped charge 2 is separated from another shaped charge 2 by way of placing a shielding panel 4 between them. As shown in FIG. 1, interlayer shielding panels 4A are placed between two layers of shaped charges, such that each shaped charge 2 positioned in a top layer is separated from another shaped charge 2 positioned in a bottom layer. Top shielding panels 4B are disposed above each of the upper shaped charges 2, bottom shielding panels 4C are placed below each of the lower shaped charges 2, and perimeter shielding panels 4D are positioned around each shaped charge 2. The combination of shaped charges 2, jet spoilers and shielding panels 4A-4D are positioned within an expandable bag 5 made of a fabric, such as ballistic cloth. The expandable bag 5 is in turn placed within a transportation container 6. A disadvantage of this packaging assembly is that the shielding panels 4 and expandable bag 5 may be unable to contain metal shrapnel in the event of detonation, resulting in mass detonation of shaped charges 2 within the package as well as those in neighboring packaging assemblies, particularly when storing or shipping large shaped charges and non-circular shaped charges. Moreover, this packaging assembly is often costly if the six shielding panels are required to surround each shaped charge, as well as the time and labor needed to assemble these packages.

Other techniques of packaging shaped charges employ the use of cylindrical tubes within which two shaped charges are placed (not shown). In these techniques, a package assembly includes using end caps made of plywood, heavy paper, cardboard or wood to close each end of the cylindrical tubes. Fragment catchers made of foam rubber are typically positioned adjacent to the end caps, with the end caps being positioned between the shaped charges and the fragment catchers. In addition, the assembly often requires the use of at least two partial tubes positioned at the end of each cylindrical tube, the partial tubes having their concave sides positioned closest to the fragment catchers. A common disadvantage with these assemblies is that upon detonation, a substantial amount of force is transferred toward the end caps and fragment catchers, which do not have sufficient strength to contain resultant shrapnel.

The aforementioned packaging assemblies are costly, may not provide sufficient containment of shrapnel that may result from inadvertent detonation, and may not prevent mass detonation of the explosives, such as shaped charges, packaged therein.

In view of the disadvantages associated with currently available methods and devices for packaging explosives, such as shaped charges, there is a need for a device that improves containment of shrapnel in the event of detonation of a shaped charge, prevents and/or limits ballistic transfer from one shaped charge to another, and prevents and/or limits mass detonation of shaped charges during storage and/or transportation. Further, there is a need for a device that facilitates safe conveyance of large shaped charges and non-circular shaped charges, using private or commercial transportation means by road, rail, air or sea.

BRIEF DESCRIPTION

According to an aspect, the present embodiments may be associated with an apparatus for storing and/or shipping explosive components, such as shaped charges. The apparatus includes a shielding assembly. In an embodiment, the shielding assembly includes a shielding panel that has a body formed of a metal foam and at least one aperture adapted and configured to receive at least one shaped charge. In an embodiment, the at least one shaped charge may be positioned in at least a portion of the metal foam. Thus, the shielding assembly is capable of preventing and/or limiting ballistic transfer from one shaped charge to another shaped charge in the event of detonation of one shaped charge.

BRIEF DESCRIPTION OF THE FIGURES

A more particular description will be rendered by reference to specific embodiments thereof that are illustrated in the appended drawings. Understanding that these drawings depict only typical embodiments and are not therefore to be considered to be limiting of its scope, exemplary embodiments will be described and explained with additional specificity and detail through the use of the accompanying drawings in which.

Figure 1:
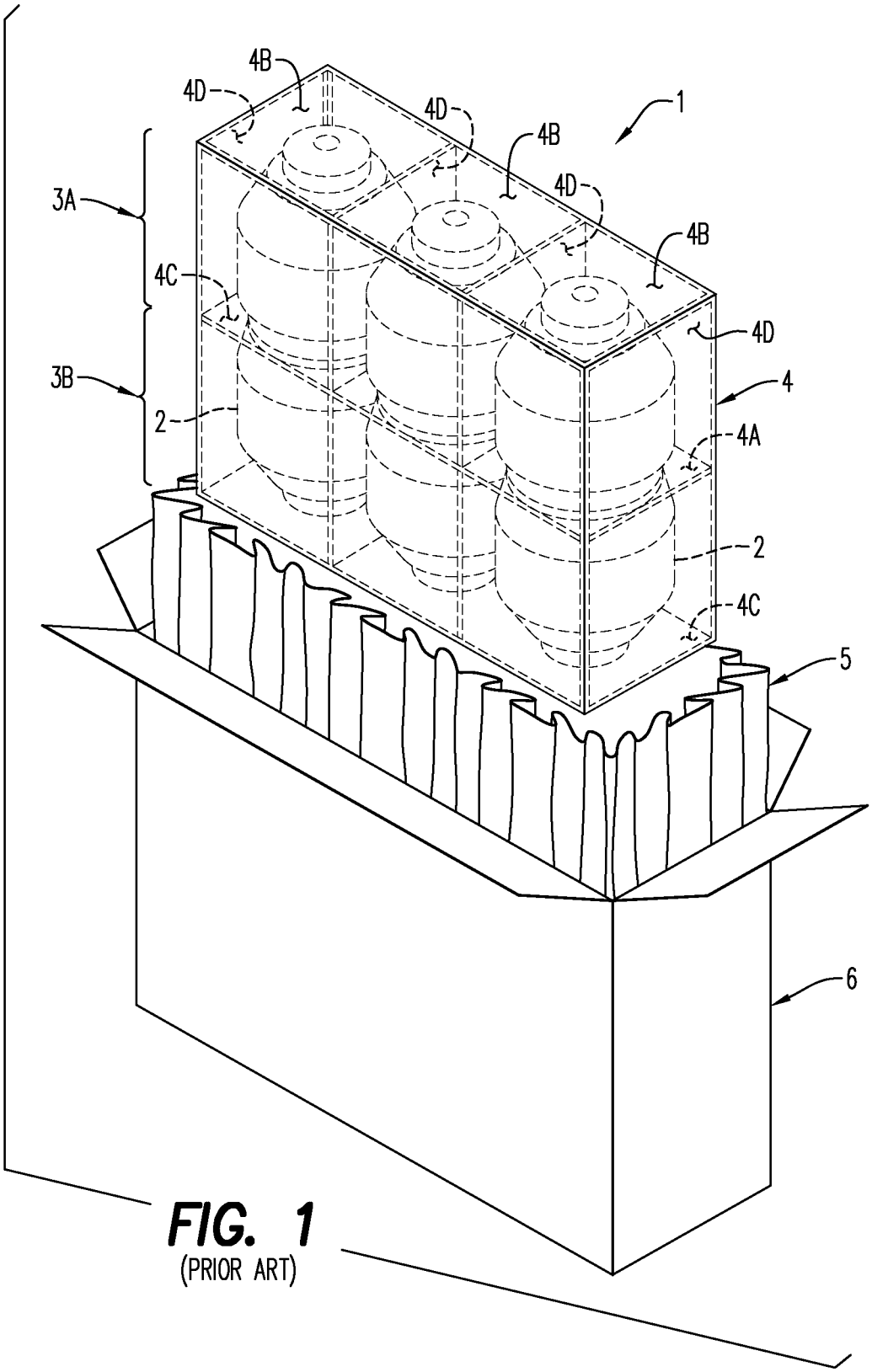
FIG. 1 (PRIOR ART)
FIG. 1 illustrates a partially exploded view of a prior art shaped charge packaging assembly.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to embodiments.

DETAILED DESCRIPTION

Reference will now be made in detail to various embodiments. Each example is provided by way of explanation, and is not meant as a limitation and does not constitute a definition of all possible embodiments.

Embodiments of the disclosure relate generally to devices and methods for storing and/or shipping explosive components, as well as a device for storing and/or shipping shaped charges using private or commercial transportation means by road, rail, air or sea. Such devices provide particular utility in providing safe conveyance of large shaped charges and non-circular shaped charges. For example, the assembly described herein may include a shielding assembly having at least one shielding panel. The shielding panel may include a body formed of a metal foam and an aperture configured for receiving at least one shaped charge. The shielding assembly contemplated may trap and absorb shrapnel and shock wave impulses in the event of detonation of the at least one shaped charge.

According to an aspect, the shielding assembly may be paired with a protective layer, such as a coating, a covering, a shield, or any other material sufficient to trap and absorb shrapnel and shock wave impulses. The thus paired assembly, including the shielding assembly and protective layer, may be placed in a container for shipping and/or storage. For example, such containers may be made of at least one of metal, wood, fiberboard, cardboard, and any other material capable of protecting the contents of the container during storage and/or transport. In an embodiment, the paired assembly is placed in an inner protective container, prior to being placed in the container for storage and/or shipping. According to an aspect, the inner protective container is positioned in a non-rigid container, and the non-rigid container is positioned in the container. Thus, the shielding assembly is capable of preventing and/or limiting ballistic transfer from one shaped charge to another shaped charge positioned in the same container and/or to another shaped charge positioned in another container. The shielding assembly is capable of preventing and/or limiting mass explosion of the shaped charges packaged therein, propagation of an explosion from one shielding assembly to another or from a non-packaged shaped charge to another shaped charge packed in a shielding assembly, and radiant heat and/or violent burning or any other dangerous effect in the event that the shielding assembly is involved in a fire. In other words, the shielding assembly is capable of passing the Test Series 6 tests recommended by the United Nations Recommendations on the Transport of Dangerous Goods.

For purposes of illustrating features of the embodiments, examples will now be introduced and referenced throughout the disclosure. Those skilled in the art will recognize that these examples are illustrative and not limiting and are provided purely for explanatory purposes.

In an embodiment, and with particular reference to FIGS. 2A, 2B, 2C and 2D, an apparatus 10 for storing and/or shipping at least one shaped charge 20 is provided. The apparatus 10 is illustrated having a shielding assembly 30 including a shielding panel 40. In an embodiment, the shielding assembly 30 is configured to receive the at least one shaped charge 20. The shielding panel 40 is shown including a body 41 and an aperture 46 configured for receiving the at least one shaped charge 20. In an embodiment, the body 41 is formed of metal foam. The shielding assembly 30 may include a retention feature (not shown) capable of aligning and/or holding the at least one shaped charge 20 in a desired position.

As illustrated in FIGS. 2A, 2B, 2C and 2D, the shielding panel 40 may include an upper layer 42, a lower layer 43, and an inner layer 44 positioned between the upper and lower layers 42, 43. In an embodiment, the body 41 forms inner layer, such that the inner layer 44 is essentially a metal foam layer. The type of material selected to form the metal foam may be selected based on the specific shaped charge or explosive components, i.e., based on the specific application. In some embodiments, the metal foam includes at least one of aluminum, steel, iron, or combinations thereof. The metal foam may be composed of various metal alloys. In some embodiments, the metal foam is a porous irregular structure and may be formed from various methods, including gas injection within a metallic structure, powder metallurgy, casting, metallic deposition, sputter deposition, and/or heat treatment of aluminum powder. The metal foam may be bonded together with sheet metal composed of various metal alloys, such as steel.

In an embodiment, at least one of the upper and lower layers 42, 43 may be formed from a sheet metal, such that the shielding panel 40 is essentially a foam sandwich. It is to be understood that while a single upper layer 42 and lower layer 43 are referenced, the upper and lower layers 42, 43 may each be composed of 2, 3, 4, 5, or more layers of sheet metal. According to an aspect, the shielding panel 40 is an aluminum foam sandwich (AFS), wherein the inner layer 44 is composed of aluminum metal foam and is positioned between the upper and lower layers 42, 43. In some embodiments, the shielding panel 40 is a steel foam sandwich (SFS), wherein the inner layer 44 is composed of a steel metal foam and is positioned between the upper and lower layers 42, 43. The shielding panel 40 may be a steel aluminum steel (SAS) sandwich, wherein the inner layer 44 is composed of aluminum foam and is positioned between the upper and lower layers 42, 43 being composed of steel. According to an aspect, each of the AFS, SFS and SAS has different properties, such as different structures and densities, and may be selected based on the desired application. The inner layer 44 may be formed from a composite metal, such that the foam is a blend of two or more types of metals. The foam sandwich may include metal foam composed of iron positioned between the upper layer 42 and the lower layer 43.

Figure 2A:
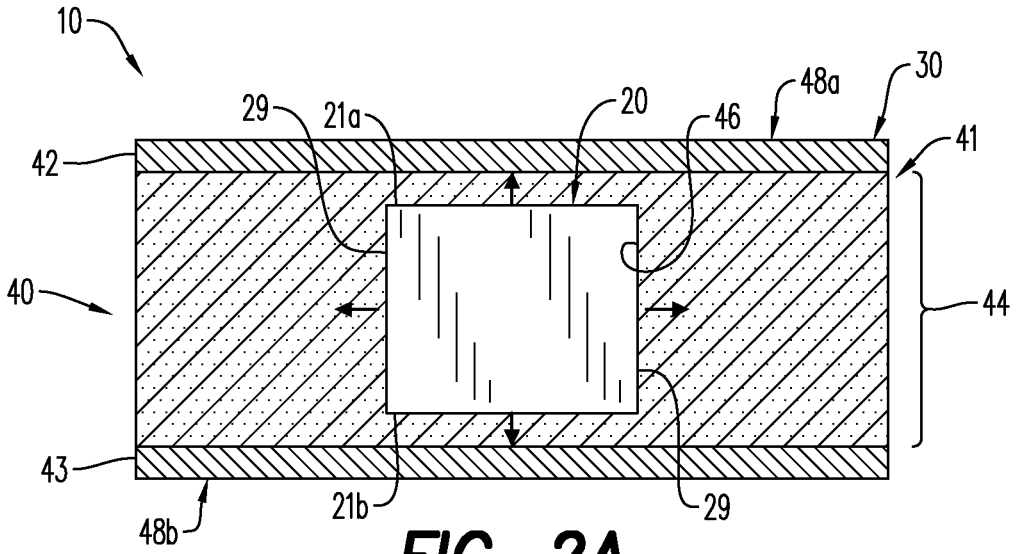
FIG. 2A is a cross-sectional view of a shielding assembly illustrating a position of a shaped charge therein, according to an embodiment.

In an embodiment and as shown in FIG. 2A, the shaped charge 20 may be positioned entirely within the inner layer 44, such that it is positioned between the upper layer 42 and the lower layer 43 and does not touch the upper and lower layers 42, 43. As shown in FIG. 2A, the sides 29 of the shaped charge 20 are adjacent the inner layer 44, but it is possible to orient the shaped charge 20 in any direction within the shielding panel 40. When the shaped charge 20 is positioned entirely within the inner layer 44, the shaped charge can be oriented in any direction (see, for example, the arrows in FIG. 2A), such that in the event of inadvertent detonation of the shaped charge 20, the jet will be oriented towards and/or into the inner layer 44.

In an embodiment, the upper edge 21*a* of the shaped charge 20 may be positioned such that it is below the upper surface 48*a* of the upper layer 42 and the lower edge 21*b* of the shaped charge 20 is positioned above the lower surface 48*b* of the lower layer 43.

Figure 2B:
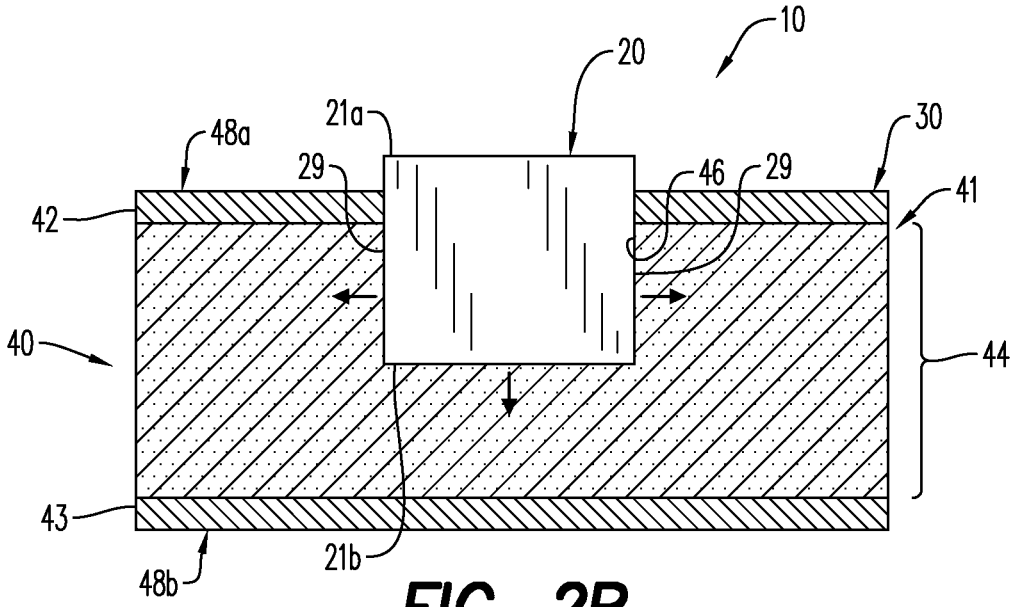
FIG. 2B is a cross-sectional view of a shielding assembly, according to an embodiment.

According to an aspect and as shown in FIG. 2B, the aperture 46 may extend through at least the upper layer 42 and at least a portion of the inner layer 44, but not the lower layer 43. Therefore, in this embodiment, when the shaped charge 20 is positioned in the aperture 46, the shaped charge 20 extends through the upper layer 42 and at least a portion of the inner layer 44. Thus, at least a portion of the shaped charge 20 may be raised relative to or may extend above the upper surface 48*a* of the upper layer 42 of the shielding panel 40. According to an aspect, the aperture 46 may be sized to receive any size or shape of a shaped charge 20, while in another embodiment, the aperture 46 is sized sufficient to house at least one of a large (20*g* and above) shaped charge 20 and a non-circular shaped charge 20. In an embodiment, the upper edge 21*a* of the shaped charge 20 may be positioned such that it is at least slightly raised relative to or extends beyond the upper surface 48*a* of the upper layer 42, while the lower edge 21*b* of the shaped charge 20 is positioned entirely within the inner layer 44 and is raised relative to the lower surface 48*b* of the lower layer 43. As used herein, the words "upper" and "lower" are not necessarily intended to indicate an "up" or "down" direction, but rather are intended to distinguish one surface (or edge) from another. In any event, in the embodiment shown in FIG. 2B where the lower edge 21*b* extends into the inner layer 44, it will be understood that this lower edge refers to the surface of the shaped charge 20 from which the jet will erupt, that is, the "liner" side of the shaped charge 20.

Figure 2C:
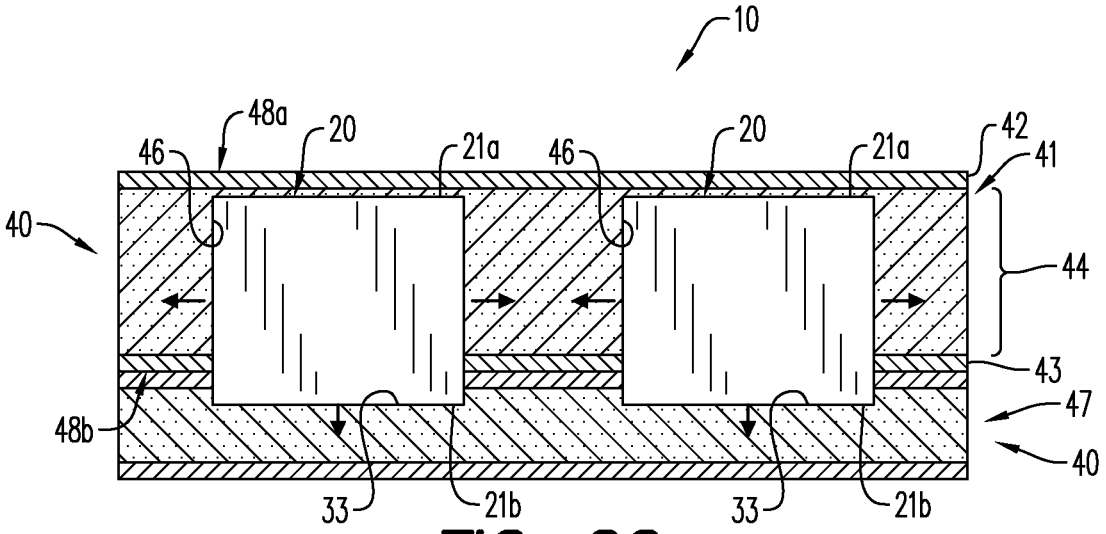
FIG. 2C is a cross-sectional view of a shielding assembly, according to an embodiment.
Figure 2D:
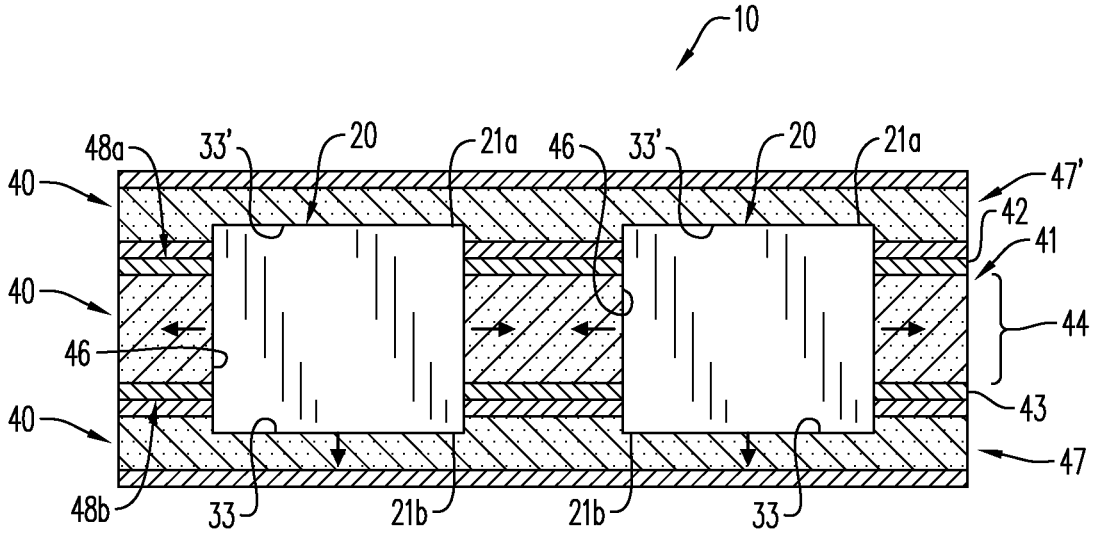
FIG. 2D is a cross-sectional view of a shielding assembly, according to an embodiment.

According to an aspect and as shown in FIGS. 2C and 2D, it is possible to have more than one shielding panel 40 in a stacked arrangement. In such an embodiment, it is envisioned that in at least one of such shielding panels 40, the aperture 46 may extend entirely through the upper layer 42, the inner layer 44 and the lower layer 43. Thus, the lower edge 21*b* of the shaped charge 20 may extend below the lower surface 48*b* of the lower layer 43 of the at least one shielding panel 40, when positioned in the shielding panel 40. As shown in FIG. 2C, the apparatus 10 includes a shielding assembly 30, in combination with a protective layer 47 (as shown and described in further detail hereinbelow), while in FIG. 2D, the apparatus 10 includes a shielding assembly 30 sandwiched between two protective layers 47, 47'. Thus, at least a portion of the protective layer 47, 47' has a corresponding aperture 33, 33' that is adapted and configured for receiving at least a portion of the shaped charge 20.

According to an aspect and as shown in FIG. 2C, when the at least one shaped charge 20 is positioned in the aperture 46 of the shielding panel 40, the upper edge 21*a* of the shaped charge 20 may extend below the upper surface 48*a* of the upper layer 42 of the shielding panel 40 and the lower edge 21*b* of the shaped charge 20 may extend below the lower surface 48*b* of the lower layer 43. In this embodiment, a portion of the shaped charge 20 is lowered relative to or extends below the upper surface 48*a* of the upper layer 42, while a portion of the shaped charge 20 extends beyond the lower surface 48*b* of the lower layer 43 of the shielding panel 40. Thus, the lower edge 21*b* of the at least one shaped charge 20 may be positioned or seated within the aperture 33 of the protective layer 47. The shaped charge 20 is positioned and arranged within the shielding panel 40 so that the upper edge 21*a* of the shaped charge 20 traverses at least a portion of the body 41 of the shielding panel 40 and the lower edge 21*b* traverses at least a portion of the protective layer 47. In any event, in such an arrangement, in the event of inadvertent detonation of the shaped charge 20, the thus-formed jet will be oriented towards the body 41 of the shielding panel 40 (see, for example, the arrows in FIG. 2C).

In some configurations and as shown in FIG. 2D, when positioned in the aperture 46, the upper edge 21*a* of the at least one shaped charge 20 extends above the upper surface 48*a* of the upper layer 42 of the at least one shielding panel 40 and the lower edge 21*b* of the shaped charge 20 extends below the lower surface 48*b* of the lower layer 43. In this embodiment, at least a portion of the body of the shaped charge 20 extends beyond the upper surface 48*a* of the upper layer 42 and the lower surface 48*b* of the lower layer 43 of the shielding panel 40. As illustrated in FIG. 2D, protective layer 47' may be positioned adjacent to upper layer 42 and protective layer 47 may be positioned adjacent to lower layer 43. In this configuration, protective layers 47, 47' may also trap and absorb shrapnel and shock wave impulses in the event of detonation of the shaped charge 20. As described illustrated in FIG. 2D, protective layer 47' may be positioned adjacent to upper layer 42 and protective layer 47 may be positioned adjacent to lower layer 43. The protective layers 47, 47' may be a coating, a covering, a shield, or any other material sufficient to trap and absorb shrapnel and shock wave impulses in the event of detonation of the at least one shaped charge 20. According to an aspect, the protective layers 47, 47' are a shielding panel 40. According to an aspect, the protective layers 47, 47' are formed of a metal foam. The protective layers 47, 47' may be formed of a material substantially the same as the shielding panel 40. According to an aspect, the protective layer 47, 47' is one of an AFS, a SFS and a SAS sandwich. Each of the AFS, SFS and SAS may have different properties, such as different structures and densities, and may be selected based on the desired application. The protective layers 47, 47' may be composed of substantially the same material used to form the body 41 of the shielding panel 40. In alternative embodiments, the protective layers 47, 47' are made of a material other than the material used to make the body 41 of the shielding panel 40. For example, in embodiments where the body 41 of the shielding panel 40 is composed of aluminum foam, one or more of the protective layers 47, 47' may be composed of steel foam, iron foam, alloys of aluminum, or any combinations thereof.

In some aspects, the shaped charge 20 may be adjacent to and/or touch the lower layer 43, but not the upper layer 42 (not shown). The shaped charge 20 may be adjacent to and/or touch the lower layer 43, but not the lower surface 48*b* of the lower layer 43. Alternatively, the shaped charge 20 may be adjacent to and/or touch the upper layer 42, but not the lower layer 43. In some aspects, the shaped charge 20 may be adjacent to and/or touch the upper layer 42, but not the upper surface 48*a* of the upper layer 42. While FIGS. 2A and 2D show the shaped charge 20 being positioned in a central position in the shielding panel 40, it is to be understood that the shaped charge 20 may be positioned at any location sufficient to safely store and/or ship shaped charges 20, such that in the event of detonation of the at least one shaped charge 20, the shielding assembly 30 can trap and absorb shrapnel and shock wave impulses. According to an aspect, the position of an individual shaped charge 20 is sufficiently separated by a space/span between one or more adjacent shaped charge(s) 20 to absorb and/or trap the shrapnel and keep adjacent shaped charges 20 from detonating.

Figure 3:
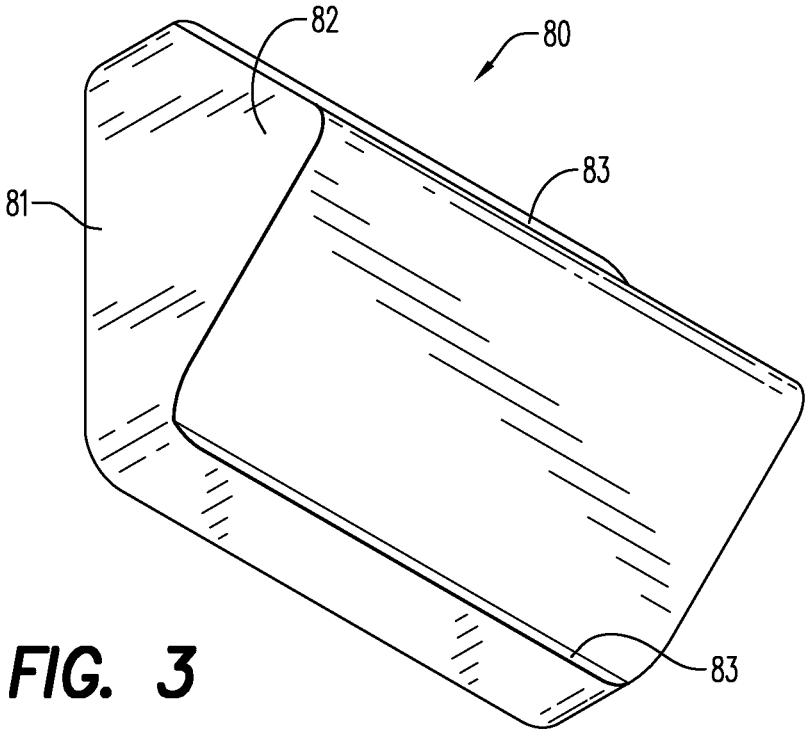
FIG. 3 is a perspective view of an inlay that can be used with a shielding assembly, according to an embodiment.
Figure 4:
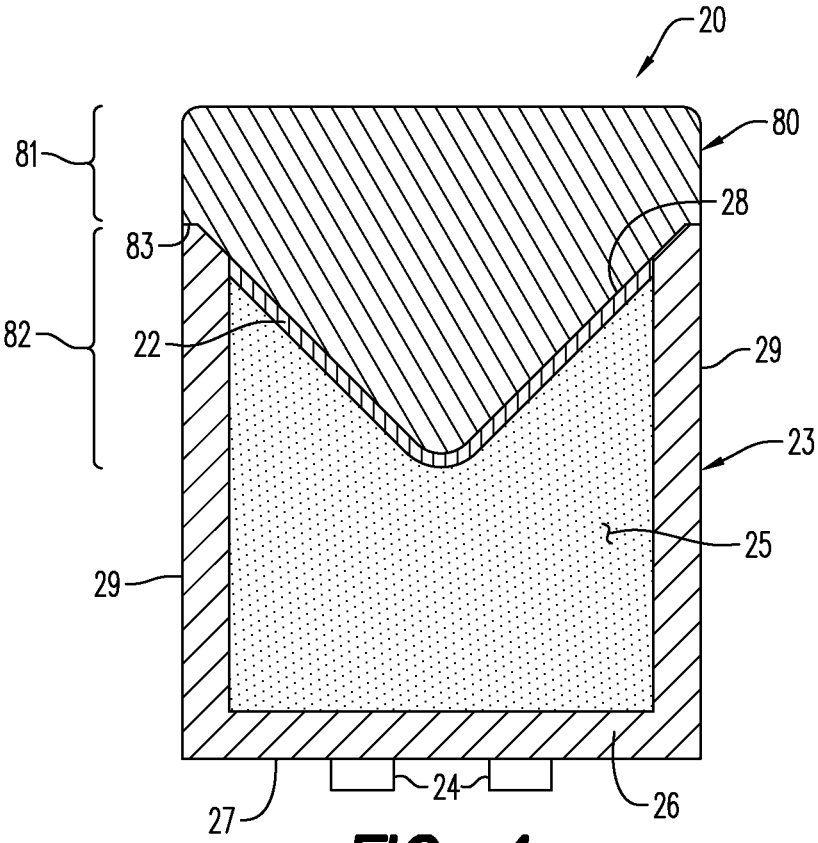
FIG. 4 is a cross-sectional side view of the inlay of FIG. 3 positioned in a shaped charge, according to an embodiment.

In some embodiments and as shown in FIGS. 3 and 4, the shaped charge 20 is provided with an inlay 80. As illustrated in FIG. 3, the inlay 80 may include an upper inlay portion 81 and a lower inlay portion 82. The inlay 80 may include an incombustible material, such that the inlay 80 does not ignite, combust and/or become consumed by fire. According to an aspect, the inlay 80 includes at least one of plastic, cardboard, wood, fiberboard and metal, and is capable of disrupting creation and/or development of the jet. The inlay 80 may be solid, hollow and/or filled with a material. Such material may include sand, foam, plastic gel, and/or metal. As illustrated in FIG. 4, the shaped charge 20 includes a casing 23 and an explosive load 25 positioned in the casing 23. The explosive load 25 is retained within the opening 28 of the shaped charge 20 by the liner 22. In an embodiment, guiding members 24 are positioned on an external surface 27 of the back wall 26 of the casing 23. The guiding members 24 are typically configured to position and/or align a detonating cord (not shown). The inlay 80 may be positioned in the shaped charge 20. The lower inlay portion 82 may have a shape that is substantially complimentary to the shape of the liner 22, such that the lower inlay portion 82 is positioned in the opening 28 of the shaped charge 20 and adjacent the liner 22. As shown in FIG. 4, and in an embodiment, while the lower inlay portion 82 is received within the opening 28, the upper inlay portion 81 extends above the upper edge 21*a* of the shaped charge 20, and partially extends over sides 29 of the shaped charge 20. In an embodiment, the upper inlay portion 81 includes a lip 83. According to an aspect, the lip 83 is larger than the size of the casing 23 of the shaped charge 20. The lip 83 may entirely cover the open end, i.e., the opening 28, of the shaped charge 20. In some embodiments, the lip 83 is sized such that it does not cover, but is contiguous with the casing 23.

In an embodiment, the inlay 80 of the at least one shaped charge 20 positioned in one shielding panel 40 will oppose the inlay 80 of another shaped charge 20 positioned in an adjacent shielding panel 40. As illustrated in FIG. 4, the shaped charge 20 includes an explosive load 25. In this embodiment, the inlay 80 may defocus and/or deviate the collapse of the liner 22, and thus, is capable of inhibiting and/or preventing jet formation in the event of inadvertent detonation of one of the at least one shaped charge 20. It is possible that not all of the apertures 46 formed in shielding panel 40 may include a shaped charge 20 (not shown).

Figure 5:
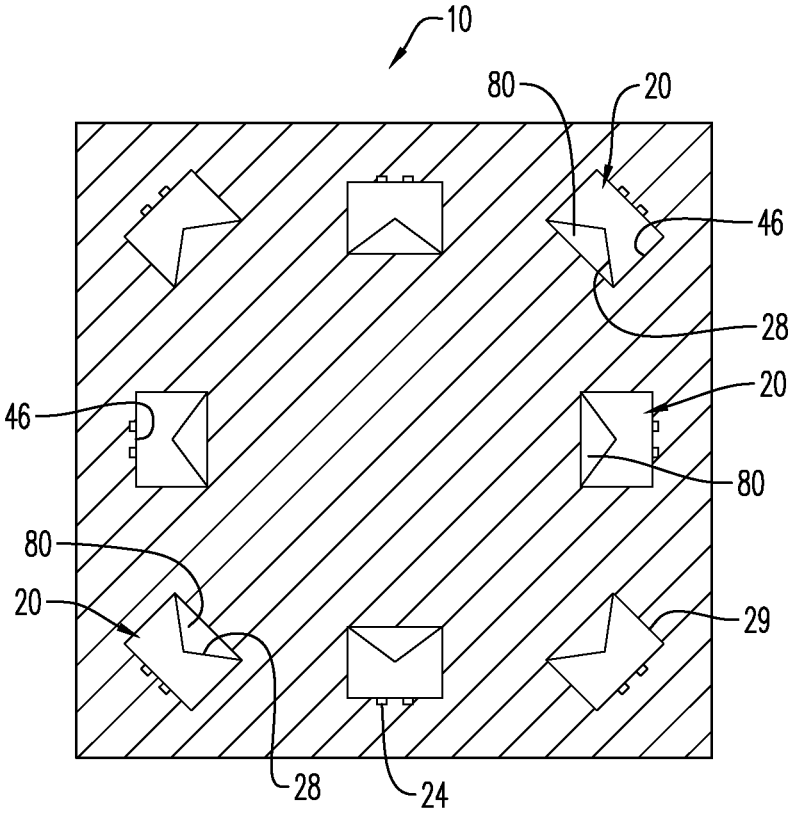
FIG. 5 is a cross-sectional view of a shielding assembly, having apertures formed within a shielding panel and shaped charges arranged therein, according to an embodiment.
Figure 6:
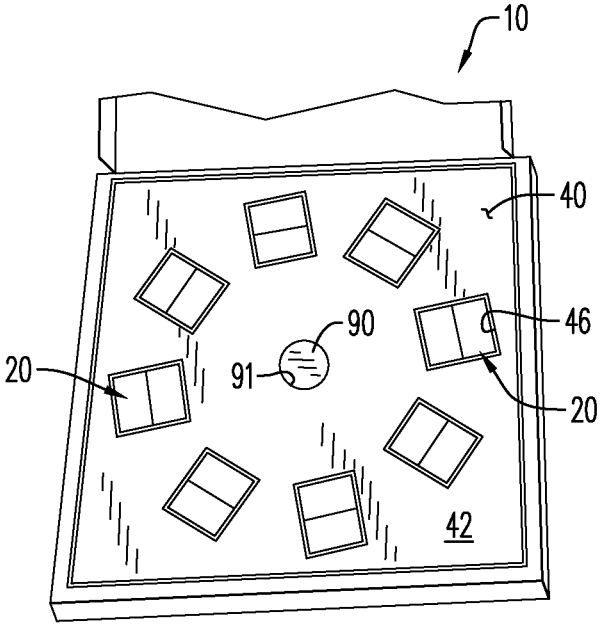
FIG. 6 is a top view of a shielding assembly, having apertures formed within a shielding panel and shaped charges and a jet interrupter arranged therein, according to an embodiment.
Figure 7:
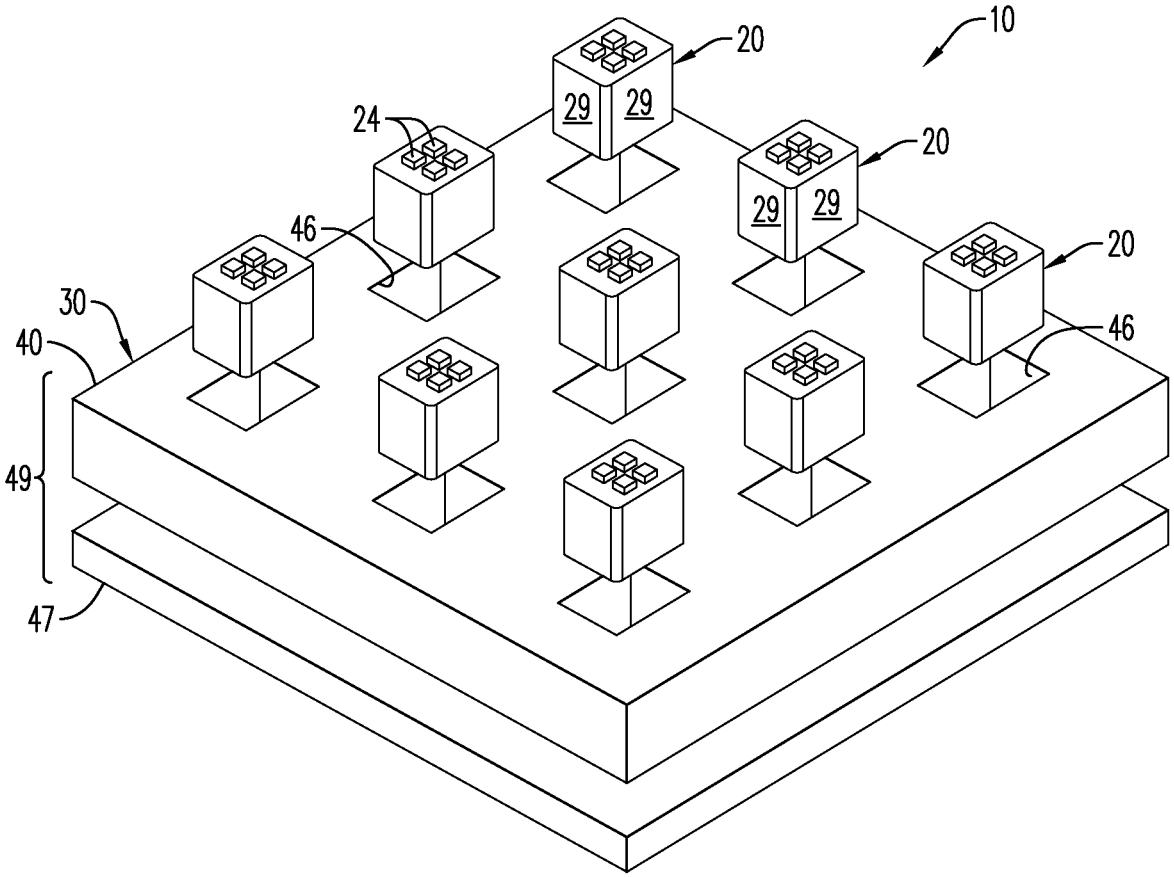
FIG. 7 is a perspective view of a shielding assembly, having apertures formed within a shielding panel, according to an embodiment.

Now referring to FIGS. 5, 6 and 7, in some aspects, multiple shaped charges 20 are arranged in a single shielding panel 40. As illustrated in FIGS. 5 and 6, and in at least an embodiment, the apertures 46 of the shielding panel 40 are oriented in a substantially circular arrangement. According to an aspect and as illustrated in FIG. 5, the shaped charges 20 are positioned within the shielding panel 40, such that their openings 28 substantially face a substantially center portion of the shielding panel 40. When shaped charges 20 are positioned in the circularly-arranged apertures 46, each of the shaped charges 20 may be arranged such that their openings 28 substantially face the openings 28 of other shaped charges 20 positioned in the same shielding panel 40. According to an aspect, the shaped charges 20 are sufficiently spaced apart and/or arranged within the shielding panel 40 such that in the event of inadvertent detonation of at least one of the shaped charges 20, shrapnel and shock wave impulses may be trapped and absorbed within the inner layer 44 (not shown). In an embodiment, the external surfaces 27 of the shaped charges 20, including the guiding members 24, are positioned in at least a portion of the upper layer 42 and at least a portion of the inner layer 44. (See, for example, FIG. 2B). According to an aspect, openings 28 of shaped charges 20 may be positioned entirely within the inner layer 44. (See, for example FIG. 2A). In the event of inadvertent detonation of shaped charges 20 including inlays 80, the inlays 80 may defocus and/or deviate the collapse of the liner 22, and thus, is capable of inhibiting and/or preventing jet formation in the event of inadvertent detonation of one of the at least one shaped charge 20.

Now referring to FIG. 6, the shielding panel 40 may include a jet interrupter 90 positioned within the shielding panel 40 such that when shaped charges 20 are also positioned within the shielding panel 40, the jet interrupter 90 is situated to substantially interrupt a jet resulting from inadvertent detonation of one or more of the shaped charges 20. With particular reference to the embodiment depicted in FIG. 6, a top view of the apparatus 10 is presented in which 8 shaped charges 20 are positioned radially inwardly within the shielding panel 40, with the liner side (not shown) of each shaped charge 20 pointing towards the center of the shielding panel 40. The jet interrupter 90 is seated within a foramen 91 that has been centrally positioned within the shielding panel 40 such that each of the radially positioned shaped charges 20 are directed towards the jet interrupter 90.

In an embodiment, the foramen 91 extends at least through the upper layer 42 and at least a portion of the inner layer 44 of the shielding panel 40. (Not shown). The foramen 91 may extend through the upper layer 42, the inner layer 44 and the lower layer 43 of the shielding panel (not shown). According to an aspect, the foramen 91 is configured to receive the jet interrupter 90 therein. The jet interrupter 90 may include an incombustible material, such that the jet interrupter 90 does not ignite, combust and/or become consumed by fire in the event of inadvertent detonation of the shaped charge 20. According to an aspect, the jet interrupter 90 is made of a material including at least one of plastic, cardboard, wood, fiberboard and metal, and is capable of disrupting the jet. The jet interrupter 90 may be solid, hollow and/or filled with a filler material. Such filler material may include sand, foam, plastic gel, and/or metal. According to an aspect, the jet interrupter 90 may have a shape that is spherical, cylindrical, tapered or any other desired shape. As such, the foramen 91 may be of any size and/or shape that is complementary to and/or capable of receiving the jet interrupter 90. In an embodiment, the shaped charges 20 are arranged such that their openings 28 are in a face-to-face arrangement. The jet interrupter 90 may be positioned between the openings 28, such that the jet interrupter 90 at least inhibits and/or limits transference of a jet formed from one or more of the at least one shaped charge 20 upon inadvertent detonation of one or more of the at least one shaped charge 20. In some embodiments and as illustrated in FIG. 6, in the event of inadvertent detonation of shaped charges 20 positioned within shielding panels 40, the jet interrupter 90 may at least inhibit and/or limit transference of the jet formed from shaped charges 20.

In some embodiments, and as shown in FIGS. 5 and 6, each shielding panel 40 has at least eight apertures 46 formed therein. However, it is to be understood that the number of apertures 46 formed within the shielding panel 40 may be selected based on the desired packing arrangement. In an embodiment, the number of apertures 46 formed within the shielding panel 40 is selected based on the number of shaped charges 20 that can be positioned within a single perforating gun (not shown). According to an aspect, the shielding panel 40 has 6, 7, 8, 9, less than or more apertures 46 formed therein.

As illustrated in FIG. 7, the shielding panel 40 may include apertures 46 arranged in one or more rows. According to an aspect, the shaped charges 20 may be positioned in the apertures 46, such that guiding members 24 are not in direct contact with the lower layer 43, the inner layer 44 or the upper layer 42 (not shown). In this embodiment, all the sides 29 of the shaped charge 20 are in direct contact with at least the inner layer 44 (not shown) and each side 29 of one shaped charge 20 generally face the side 29 of at least one neighboring shaped charge 20. Each aperture 46 is sufficiently spaced apart from other apertures 46, such that shaped charges 20 positioned therein are not in direct contact with neighboring shaped charges 20.

As illustrated in FIG. 7, and according to an aspect, the apparatus 10 for storing and/or shipping at least one shaped charge 20 may include a protective layer 47. In some embodiments, each of the at least one shielding assembly 30 is paired with one or more of its own protective layer 47, such that the protective layer 47 is positioned substantially adjacent to the shielding panel 40. While FIG. 7 depicts the apparatus 10 including one shielding assembly 30 paired with one protective layer 47 to form a paired shielding assembly 49, in some embodiments, each apparatus 10 includes at least 2, 3, 4, 5, 7, 8, or more paired shielding assemblies 49. According to an aspect, the shielding panel 40 may be provided with 2, 3, 4, 5 or more protective layers 47. (See, for instance, FIG. 2D.)

Figure 8:
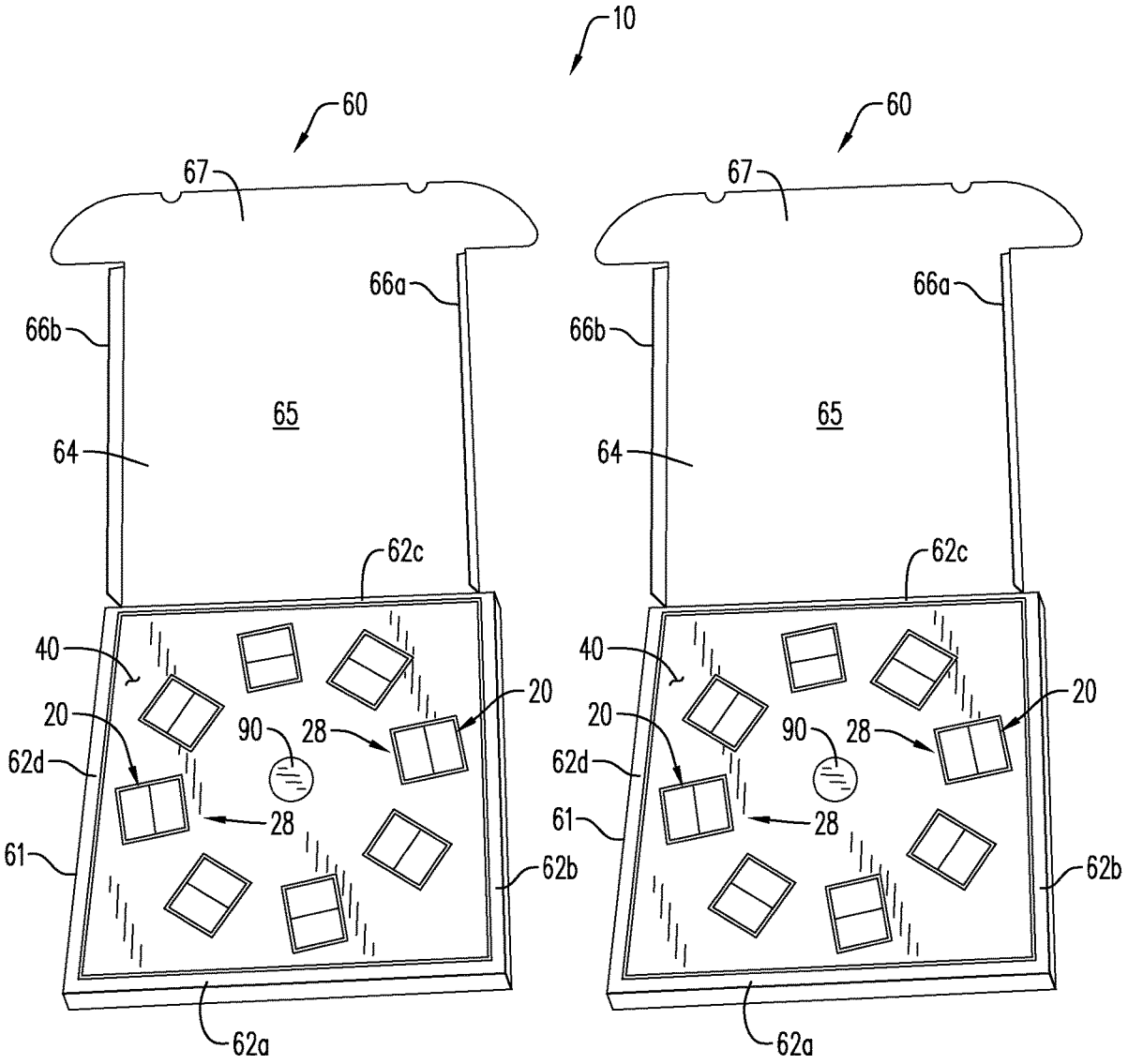
FIG. 8 is a perspective view of a shielding assembly according to FIG. 6 positioned in an inner protective container, according to an embodiment.
Figure 9:
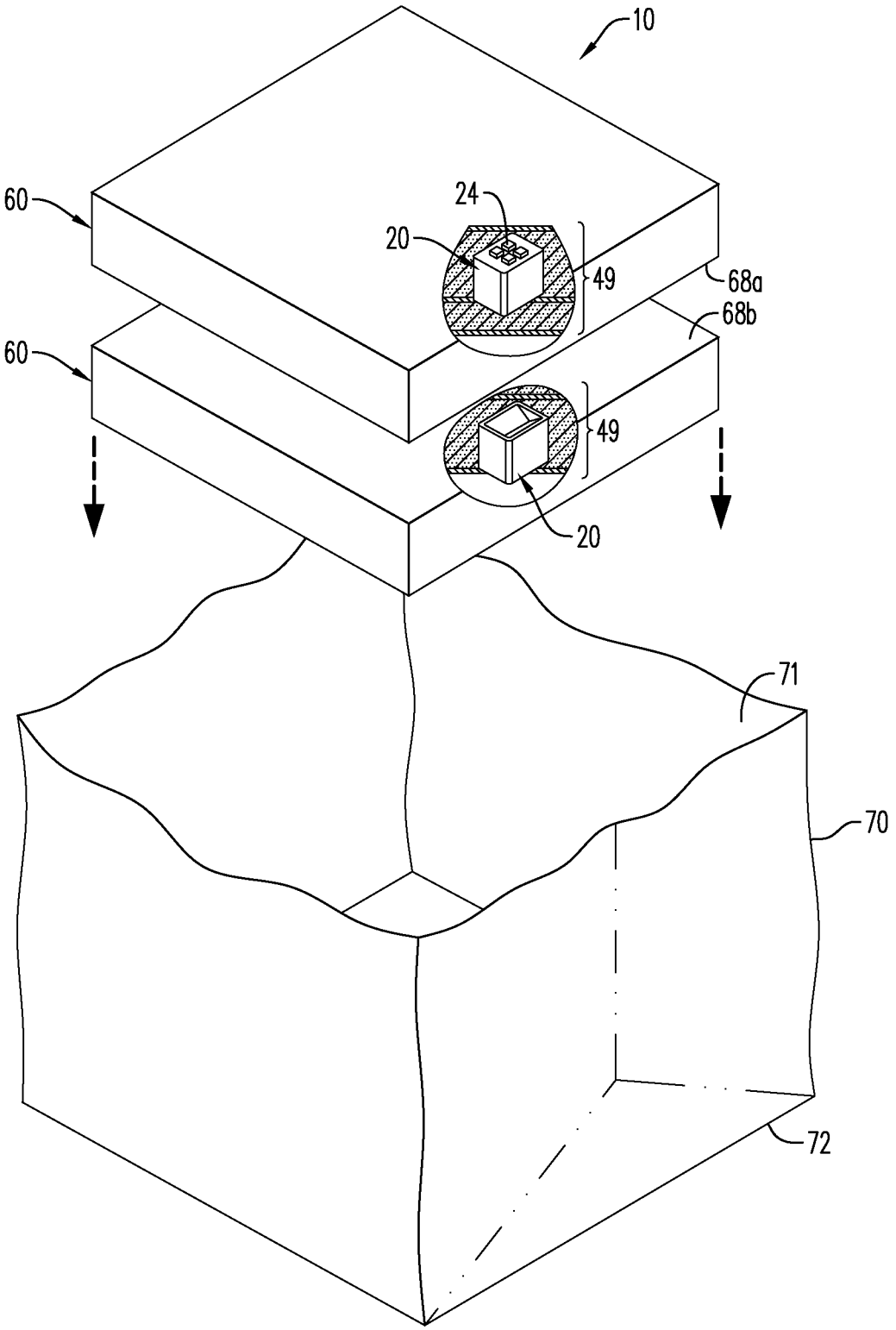
FIG. 9 is a perspective view of the shielding assembly of FIG. 7 positioned in an inner protective container and placed in a non-rigid container, according to an embodiment.

According to an embodiment and as illustrated in FIGS. 8 and 9, the shielding panel 40 may be positioned within an inner protective container 60. The inner protective container 60 may be composed of cardboard, fiberboard, wood, metal or any combinations thereof. The inner protective container 60 may be arranged as a "pizza box" configuration. In such a configuration, the inner protective container 60 may include a body portion 61 having four sides 62*a*, 62*b*, 62*c*, 62*d* and a bottom 63 (not shown). In this embodiment, a lid 64 is attached to the body portion 61 and is configured to securely close the inner protective container 60. The lid 64 may include a top wall 65 having two side flaps 66*a*, 66*b* and a closure flap 67 extending therefrom. In this embodiment, the lid 64 extends from the side 62*d*, such that when folded over the body portion 61, the flaps 66*a*, 66*b* are seated internally to the sides 62*a*, 62*b*, respectively. According to an aspect, the inner protective container 60 is configured to receive one or more of the shielding panels 40 having a pair of shaped charges 20 arranged such that their openings 28 are in a face-to-face arrangement and the jet interrupter 90 is positioned between the openings 28. In such configurations, shaped charges 20 positioned in one shielding panel 40 are positioned in an orientation facing a surface 68*a*, 68*b* of the inner protective container 60. (See, for instance, FIGS. 9 and 10.)

According to an aspect and with particular reference to FIG. 9, the inner protective container 60 is adapted and configured to receive and/or secure at least one paired shielding assembly 49 therein. In an embodiment, the inner protective container 60 is sized to receive 2, 3, 4, 6, 7, 8 or more paired shielding assembly 49. Each inner protective container 60 may receive a shielding assembly 30 having a number of shaped charges 20 desired to be placed within a single perforating gun (not shown). In embodiments having two or more pairs of inner protective containers 60, the inner protective containers 60 are positioned such that openings 28 of any shaped charge 20 positioned in one inner protective container 60 generally face the direction of the openings 28 of shaped charges 20 positioned in another inner protective container 60. It is to be understood that the opening 28 of a shaped charge 20 corresponds to the position of its respective liner 22 (as illustrated FIG. 4 and described in further detail hereinbelow).

Figure 10:
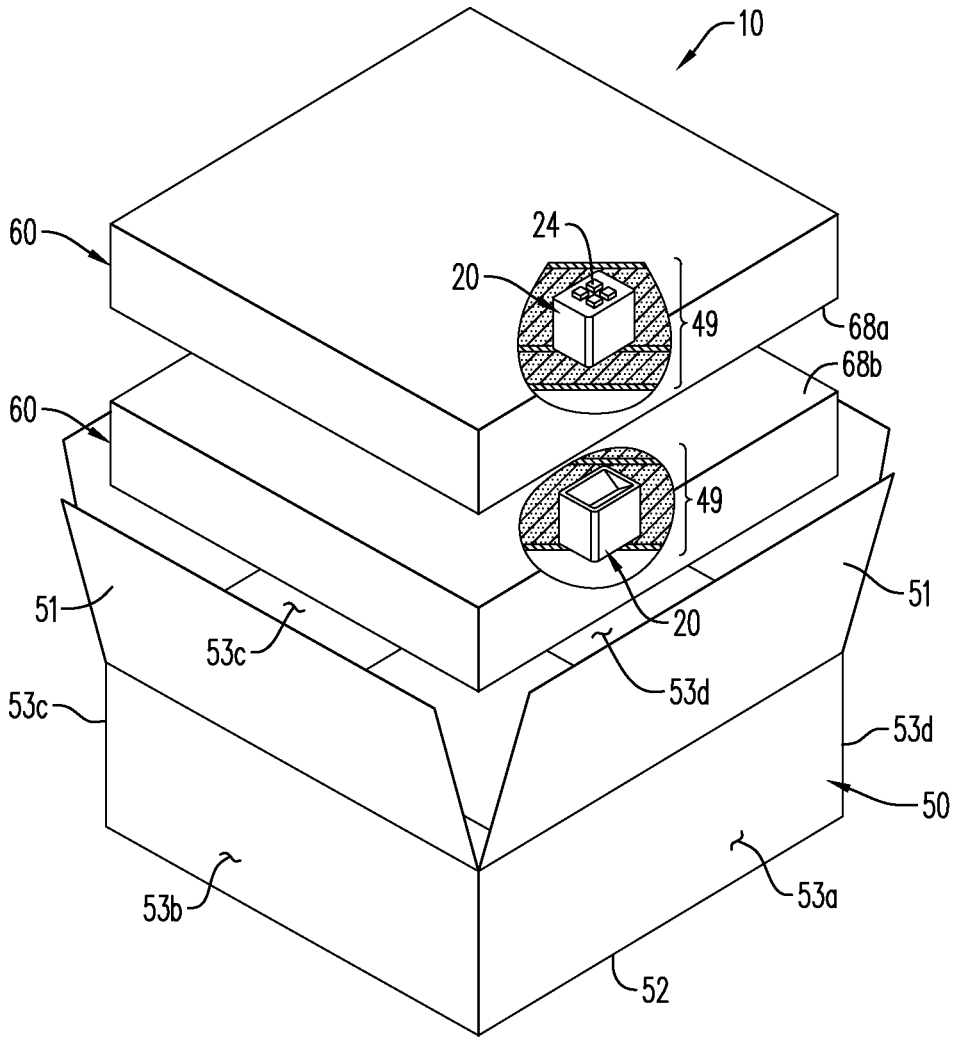
FIG. 10 is a perspective view of the shielding assembly of FIG. 7 positioned in an inner protective container that is placed in a container for storage and/or shipping, according to an embodiment.

As illustrated in FIGS. 9 and 10, in some assemblies, multiples of protective containers 60 may be oriented in a stacked arrangement, and positioned within a container 50 (FIG. 9) or a non-rigid container 70 (FIG. 10). In such configurations, the surface 68*a* of one of the protective containers 60 may be positioned in an orientation facing an opposing surface 68*b* of an adjacent protective container 60, such that the faces of the shaped charges 20 are directed towards each other. As illustrated in FIG. 9, one or more of the protective containers 60 may be positioned in the non-rigid container 70 prior to being placed in the container 50 for shipping (not shown). In an alternative embodiment and as illustrated in FIG. 10, the protective containers 60 are positioned in the container 50 and are shipped without being placed in the non-rigid container 70. According to an aspect, the container 50 is at least a semi-rigid container. The protective containers 60 may be sized to receive the shielding assemblies 30 (not shown) and may be sized to be positioned in at least one of the non-rigid container 70 and the container 50 (see, for instance, FIGS. 9 and 10 and as discussed further hereinbelow).

According to an aspect and as illustrated in FIG. 9, the non-rigid container 70 includes an open end 71 and a closed end 72 and is configured for receiving at least one inner protective container 60. The non-rigid container 70 may be configured to seal each inner protective container 60 or one or more inner protective containers 60 stacked within the non-rigid container 70. As described above, multiples of inner protective containers 60, having shielding assemblies 30 (not shown) positioned therein, may be oriented in a stacked arrangement. The multiples of inner protective containers 60 may be placed in the non-rigid container 70. The non-rigid container 70 may be positioned in a container 50 and stored and/or shipped in that configuration. In embodiments having the inner protective container 60 and/or the non-rigid container 70, the shielding assembly 30 is not in direct contact with the container 50, rather, the shielding assembly 30 is separated from the container 50 by way of having at least the inner protective container 60 or the non-rigid container 70 positioned therebetween. The non-rigid container 70 may be composed of aluminum foil, plastic, composite materials, and/or combinations thereof. The open end 71 of the non-rigid container 70 may be sealed using heat, adhesive coatings and/or twist ties. According to an aspect, the non-rigid container 70 is vacuum-sealed.

As illustrated in FIG. 10, multiples of inner protective containers 60 oriented in a stacked arrangement and including shielding assemblies 30 positioned therein, may be placed directly in the container 50. In an embodiment, the container 50 includes a top 51, a bottom 52 and four sides 53*a*, 53*b*, 53*c*, 53*d*. In an embodiment, the container 50 includes one or more inner protective containers 60. Each inner protective container 60 includes at least one paired shielding assembly 49 having shaped charges 20 positioned within the shielding panel 40 (not shown).

The components of the apparatus illustrated are not limited to the specific embodiments described herein, but rather, features illustrated or described as part of one embodiment can be used on or in conjunction with other embodiments to yield yet a further embodiment. It is intended that the apparatus include such modifications and variations.

While the apparatus has been described with reference to specific embodiments, it will be understood by those skilled in the art that various changes may be made and equivalents may be substituted for elements thereof without departing from the scope contemplated. In addition, many modifications may be made to adapt a particular situation or material to the teachings found herein without departing from the essential scope thereof.

In this specification and the claims that follow, the singular forms "a," "an" and "the" include plural referents unless the context clearly dictates otherwise. Furthermore, references to "one embodiment," "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

Advances in science and technology may make equivalents and substitutions possible that are not now contemplated by reason of the imprecision of language; these variations should be covered by the appended claims. This written description uses examples to disclose the apparatus, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. An apparatus for storing and shipping an explosive article, comprising:

a shielding assembly comprising a shielding panel comprising a body formed of a metal foam, wherein the shielding panel comprises an upper layer, a lower layer, an inner layer positioned between the upper layer and the lower layer, and an aperture extending through at least the upper layer and at least a portion of the inner layer, wherein the aperture is configured for receiving a shaped charge, and the shielding assembly is adapted and configured to trap and absorb shrapnel and shock wave impulses in the event of detonation of the shaped charge.

2. The apparatus of claim 1, least wherein an upper edge of the shaped charge is below an upper surface of the upper layer of the shielding panel when positioned in the shielding panel.

3. The apparatus of claim 1, wherein an upper edge of the shaped charge is above an upper surface of the upper layer of the shielding panel when positioned in the shielding panel.

4. An apparatus for storing and shipping an explosive article, comprising:

a container having a top, a bottom and four sides; and a shielding assembly positioned within the container, wherein the shielding assembly comprises a shielding panel, the shielding panel comprising a body formed of a metal foam, wherein the shielding panel comprises an upper layer, a lower layer, an inner layer positioned between the upper layer and the lower layer, and an aperture extending through the upper layer and at least a portion of the inner layer, wherein the aperture is configured for receiving a shaped charge, and wherein the shielding assembly is adapted and configured to trap and absorb shrapnel and shock wave impulses in the event of detonation of the shaped charge.

5. The apparatus of claim 4, wherein an upper edge of the shaped charge is below an upper surface of the upper layer of the shielding panel when positioned in the shielding panel.

6. The apparatus of claim 4, wherein an upper edge of the shaped charge is above an upper surface of the upper layer of the shielding panel when positioned in the shielding panel.

7. The apparatus of claim 4, further comprising a protective layer, wherein the shielding assembly is paired with the protective layer.

8. The apparatus of claim 7, further comprising a non-rigid container having an open end and a closed end, the non-rigid container being configured for receiving an inner protective container, wherein the shielding assembly in combination with the protective layer is positioned within the inner protective container.

9. The apparatus of claim 4, wherein the shielding panel comprises:

a plurality of shielding panels, wherein each shielding panel of the plurality of shielding panels is oriented within the container in a stacked arrangement, and an upper surface of the shielding assembly is positioned within the container in an orientation facing an upper surface of an adjoining shielding assembly.

10. The apparatus of claim 4, further comprising an inlay positioned adjacent to an opening of the shaped charge, such that when the shaped charge is positioned within the aperture of the shielding panel, the inlay is configured to prevent jet formation from the shaped charge upon inadvertent detonation of the shaped charge.

11. An apparatus for storing and shipping an explosive article, comprising:

a container having a top, a bottom and four sides;

a non-rigid container positioned within the container, the non-rigid container having an open end and a closed end; and a shielding assembly positioned within the non-rigid container, wherein the shielding assembly comprises a shielding panel and a protective layer paired with the shielding panel, the shielding panel comprising a body formed of a metal foam, an upper layer, a lower layer, an inner layer formed from the body and positioned between the upper layer and the lower layer, and an aperture formed in the body and configured for receiving a shaped charge, wherein the shielding assembly is adapted and configured to trap and absorb shrapnel and shock wave impulses in the event of detonation of the shaped charge.

12. The apparatus of claim 11, wherein the metal foam comprises aluminum, steel, iron, alloys thereof, or combinations thereof.

13. The apparatus of claim 11, wherein the metal foam comprises a highly porous, irregular-shaped pattern, which reduces the overall weight while maintaining structural integrity to trap and absorb the shrapnel.

14. The apparatus of claim 11, wherein the aperture is one aperture of a plurality of apertures and the plurality of apertures is positioned in the shielding panel in a circular arrangement.

15. The apparatus of claim 14, wherein the shaped charge has a plurality of sides and is positioned in the shielding panel such that at least one side of the plurality of sides is in direct contact with at least the inner layer.

16. The apparatus of claim 11, wherein the shaped charge comprises an opening and an external surface positioned opposite the opening, the shaped charge being positioned within the shielding panel, such that opening and the external surface are positioned within at least a portion of the inner layer.

17. The apparatus of claim 11, wherein the shielding panel further comprises a jet interrupter positioned therein.

18. The apparatus of claim 17, wherein the shaped charge is one of a pair of shaped charges, wherein each shaped charge of the pair of shaped charges comprises an opening and the pair of shaped charges is arranged such that the openings of the pair of shaped charges are in a face-to-face arrangement and the jet interrupter is positioned between the openings of the pair of shaped charges, the jet interrupter being configured to at least inhibit or limit transference of a jet formed from one shaped charge or both shaped charges of the pair of shaped charges upon inadvertent detonation of one shaped charge or both of shaped charges of the pair of shaped charges.

* * * * *